US009409756B2

(12) United States Patent
Piatnik et al.

(10) Patent No.: US 9,409,756 B2
(45) Date of Patent: Aug. 9, 2016

(54) MULTI-FLAVOR VALVE

(71) Applicant: PepsiCo, Inc., Purchase, NY (US)

(72) Inventors: Joseph Todd Piatnik, Bethel, CT (US); Fernando Ubidia, Ludlow, MA (US); Amir Farooqui, Ludlow, MA (US); Aaron M. Stein, Ludlow, MA (US); Eric Skell, Hartford, WI (US); Thomas Tagliapietra, Glendale, WI (US); William Black, Southberry, CT (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 14/153,852

(22) Filed: Jan. 13, 2014

(65) Prior Publication Data

US 2014/0124529 A1 May 8, 2014

Related U.S. Application Data

(62) Division of application No. 12/397,226, filed on Mar. 3, 2009, now Pat. No. 8,631,974, which is a division of application No. 10/846,331, filed on May 14, 2004, now abandoned.

(51) Int. Cl.
*B67D 1/00* (2006.01)

(52) U.S. Cl.
CPC ..... *B67D 1/0041* (2013.01); *B67D 1/0051* (2013.01); *B67D 1/0085* (2013.01)

(58) Field of Classification Search
CPC .. B67D 1/0036; B67D 1/0041; B67D 1/0081; B67D 1/0051; B67D 1/0085
USPC ..... 222/1, 129.1, 129.3, 129.4, 132, 135, 222/144.5, 145.1, 145.2, 148, 145.7, 222/639–642
See application file for complete search history.

(56) References Cited

U.S. PATENT DOCUMENTS

| | | | | |
|---|---|---|---|---|
| 3,441,176 | A * | 4/1969 | Reynolds et al. | 222/640 |
| 4,453,652 | A * | 6/1984 | Merkel | H01F 7/1805 222/504 |
| 5,033,651 | A | 7/1991 | Whigham et al. | |
| 5,071,070 | A | 12/1991 | Hardy | |
| 5,188,255 | A | 2/1993 | Du | |
| 5,332,123 | A * | 7/1994 | Farber et al. | 222/129.4 |
| 5,405,050 | A * | 4/1995 | Walsh | B67D 3/043 222/1 |

(Continued)

*Primary Examiner* — J. Casimer Jacyna
(74) *Attorney, Agent, or Firm* — Sterne, Kessler, Goldstein & Fox, P.L.L.C.

(57) ABSTRACT

A multi-flavor valve capable of dispensing at least three flavors of beverages is provided. The valve includes a single-piece injection-molded valve body having at least three syrup flow paths and a water flow path. The valve also includes at least three syrup flow path solenoids for respectively opening and closing the at least three syrup flow paths, and one water flow path solenoid for opening and closing the water flow path. The three syrup flow path solenoids are positioned in the corresponding syrup flow paths, and the water flow path solenoid is positioned in the water flow path, within the valve body. The valve also has at least three beverage flavor switches for selecting any one of the three beverage flavors for dispensation. The valve further includes an electronics module electrically connected to the solenoids and to the beverage flavor switches, the electronics module causing one of the syrup flow path solenoids to open the corresponding syrup flow path of the syrup corresponding to a selected flavor switch, and causing the water flow path solenoid to open the water flow path, thereby causing the multi-flavor valve to dispense the selected beverage flavor.

18 Claims, 23 Drawing Sheets

(56) References Cited

U.S. PATENT DOCUMENTS

| | | | | |
|---|---|---|---|---|
| 6,036,055 | A * | 3/2000 | Mogadam | B67D 3/0006 222/1 |
| 6,554,165 | B2 | 4/2003 | Cote | |
| 6,698,621 | B2 | 3/2004 | Landers et al. | |
| 2003/0173376 | A1 | 9/2003 | Bilskie et al. | |
| 2004/0084475 | A1 | 5/2004 | Bethuy et al. | |
| 2004/0118872 | A1 | 6/2004 | Romanyszyn et al. | |

* cited by examiner

FIG. 1 Top View Of The Valve
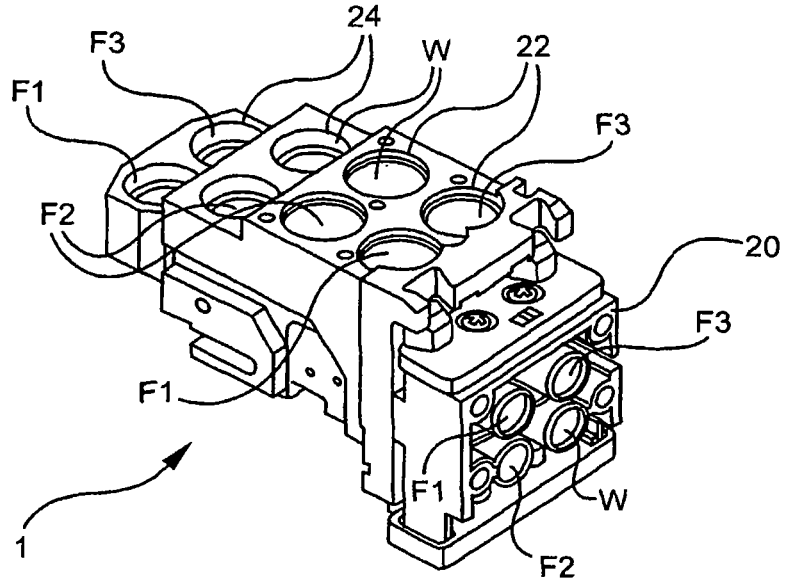
FIG. 2 Bottom View Of The Valve
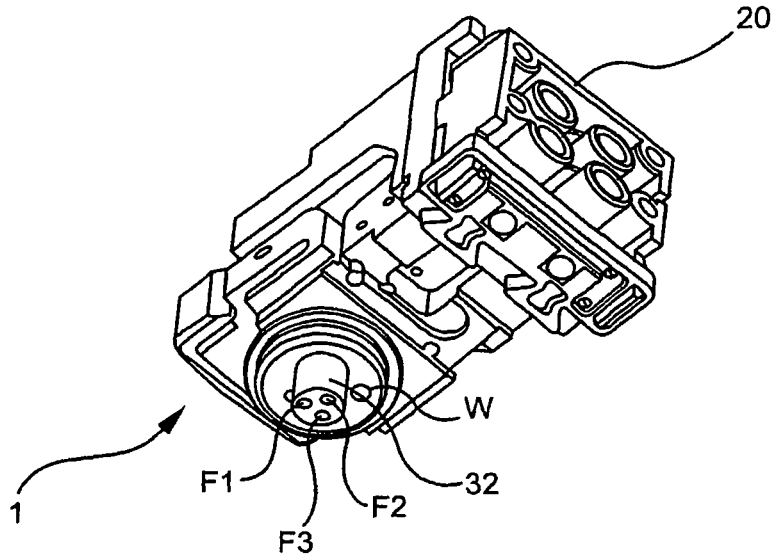

FIG. 3 Rear View Of The Valve
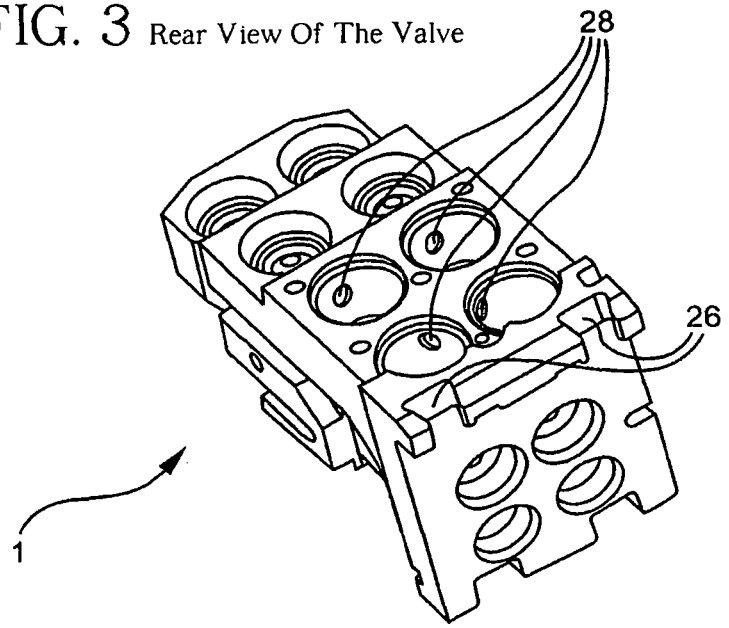
FIG. 4 Bottom View Of The Valve
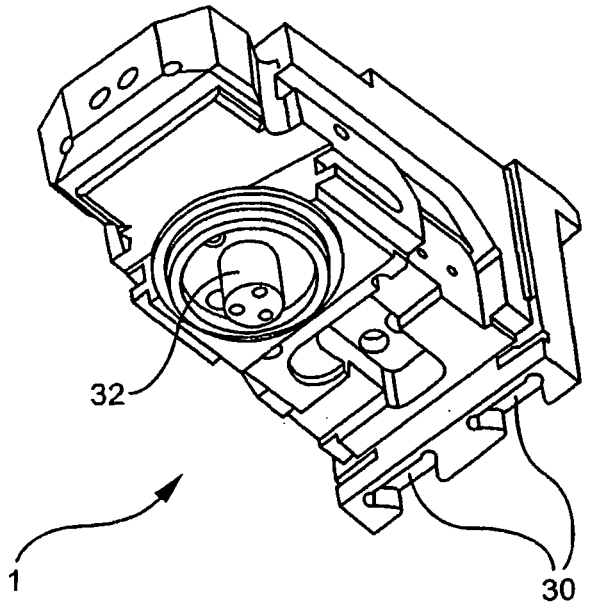

Water And Syrup Inlets
At Rear Of Valve Body

Water And Syrup Inlets
At Bottom Of Valve Body

Section A-A
F3 Flow Path
Symmetric To F2 Flowpath

Section B-B
F3 Flow Path
Symmetric to F2 Flowpath

Section C-C
W Flow Path

Section D-D
F1 Flow Path

FIG. 8A Flow Path, F1
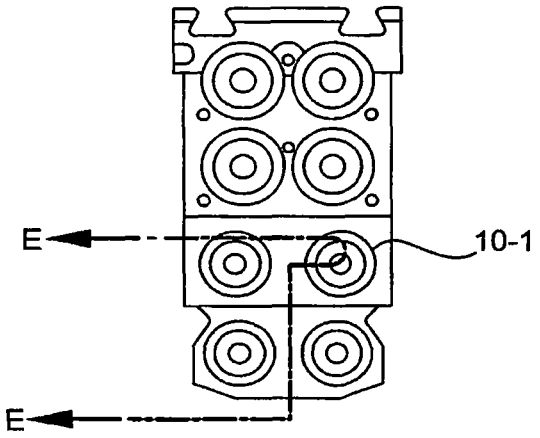
FIG. 8B Flow Path, F1
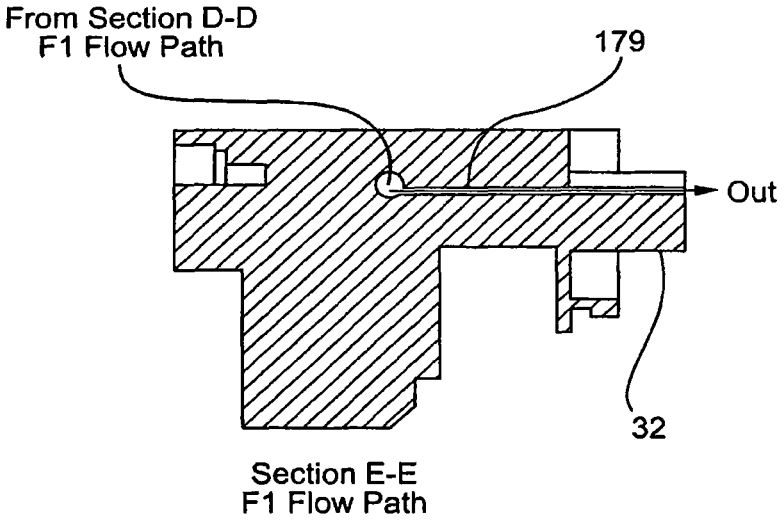

Detail D
Seal 4:1

Section A-A
Scale 1:1

Section B-B
Scale 1:1

Section C-C
Scale 1:1

Section D-D
Scale 1:1

MULTI-FLAVOR VALVE

This application is divisional of U.S. application Ser. No. 12/397,226, filed Mar. 3, 2009, which application is a divisional of U.S. application Ser. No. 10/846,331, filed May 14, 2004, which applications are herein incorporated by reference in their entirety.

FIELD OF THE INVENTION

This invention relates to a multi-flavor valve used to dispense various flavored beverages from a beverage dispenser.

BACKGROUND OF THE INVENTION

Many carbonated and noncarbonated beverages are available on the market and are in demand. For example, restaurants, cafeterias, fast food facilities, and the like often utilize beverage dispensers to provide such beverages to their customers (either from behind the counter or self-serve). These dispensers often used "post-mix" beverage dispensing valves, which use two separate flow paths to dispense water (carbonated or non-carbonated, depending on the type of beverage) and syrup into a cup, in which the water and syrup mix to produce a beverage.

Typically, post-mix beverage dispensing valves dispense only one beverage flavor per valve. The number of these "one-flavor" valves that a dispenser can accommodate is limited, and thus the valves are assigned to the most popular flavors, typically carbonated beverages (cola, diet cola, lemon-lime, root beer, etc.). Consequently, there is usually only room on the dispenser for a single noncarbonated flavor valve (e.g., iced tea), if at all. To provide additional noncarbonated beverage flavors (e.g., lemonade, pink lemonade, fruit punch, raspberry iced tea, etc.), additional dispensers are required. In many cases, these dispensers are dedicated to a single flavor, to prevent mixing flavors between beverage dispensing cycles. This takes up additional counter space, and increases beverage dispensing cost.

Currently, a "two-flavor" beverage dispensing valve exists. This valve has three flow paths (two for syrup and one for water). Current manufacturing techniques consist of machining multiple layers of the valve individually. Those layers are then laminated together to form the flow path between the layers. Incorporating additional syrup flow paths, however, makes the design more costly and complex. Further, the mixture of flavors and/or colors between beverage dispensing cycles is not insured.

SUMMARY OF THE INVENTION

To overcome the drawbacks associated with prior art one-flavor and two-flavor valves, a less complex and less costly multi-flavor valve, capable of non-simultaneously dispensing at least three beverage flavors, is provided. For example, the multi-flavor valve may be configured to dispense (besides noncarbonated water) iced tea, fruit punch and lemonade. The multi-flavor valve of the present invention substantially reduces the transfer of flavors and/or colors from one beverage dispensation to the next. The multi-flavor valve of the present invention is preferably of the same size as a standard one-flavor valve, and fits into the dispenser space normally allotted to the standard one-flavor valve.

In one aspect of the present invention, a multi-flavor valve capable of dispensing at least three flavors of beverages is provided. The valve includes a single-piece injection-molded valve body having at least three syrup flow paths and a water flow path. The valve also includes at least three syrup flow path solenoids for respectively opening and closing the at least three syrup flow paths, and one water flow path solenoid for opening and closing the water flow path. The three syrup flow path solenoids are positioned in the corresponding syrup flow paths, and the water flow path solenoid is positioned in the water flow path, within the valve body. The valve also has at least three beverage flavor switches for selecting any one of the three beverage flavors for dispensation. The valve further includes an electronics module electrically connected to the solenoids and to the beverage flavor switches, the electronics module causing one of the syrup flow path solenoids to open the corresponding syrup flow path of the syrup corresponding to a selected flavor switch, and causing the water flow path solenoid to open the water flow path, thereby causing the multi-flavor valve to dispense the selected beverage flavor.

In another aspect of the present invention, a method for dispensing a selected beverage flavor from a multi-flavor valve is provided, the multi-flavor valve having a water flow path solenoid and at least three syrup flow path solenoids. The method includes the steps of (1) opening the water flow path solenoid, (2) opening one of the syrup flow path solenoids corresponding to the selected beverage flavor after a predetermined period after the water flow path solenoid has been opened, (3) closing the opened syrup flow path solenoid after the selected beverage flavor has been dispensed, and (4) closing the water now path solenoid after another predetermined period after the syrup flow path solenoid has been closed.

In yet another aspect of the present invention, a multi-flavor valve capable of dispensing at least three flavors of beverages is provided. The valve includes a single-piece injection-molded valve body having at least three syrup flow paths and a water flow path. The valve also has an integrated diffuser for diffusing water dispensed from the water flow path. The valve also has an integrated syrup tube with at least three channels corresponding to the at least syrup flow paths, through which channels one of the syrups, corresponding to a selected beverage flavor, is dispensed at a dispensing end of the syrup tube. The surface tension of the syrups at the dispensing end of the syrup tube substantially prevents unselected syrups from dripping out of the corresponding channels during dispensation of the selected beverage flavor, thereby minimizing flavor and color contamination of the dispensed beverage flavor.

BRIEF DESCRIPTION OF THE DRAWINGS

These and other aspects of the invention will be more clearly understood by reference to the following detailed description of exemplary embodiments in conjunction with the accompanying drawings, in which:

FIG. 1 illustrates a top view of the multi-flavor valve of the present invention.

FIG. 2 illustrates a bottom view of the multi-flavor valve of the present invention.

FIG. 3 illustrates a rear view of the multi-flavor valve of the present invention.

FIG. 4 illustrates another bottom view of the multi-flavor valve of the present invention.

FIGS. 8A-8B depict the flow path syrup F1 in the multi-flavor valve of the present invention.

DETAILED DESCRIPTION OF THE INVENTION

Figure 5A:
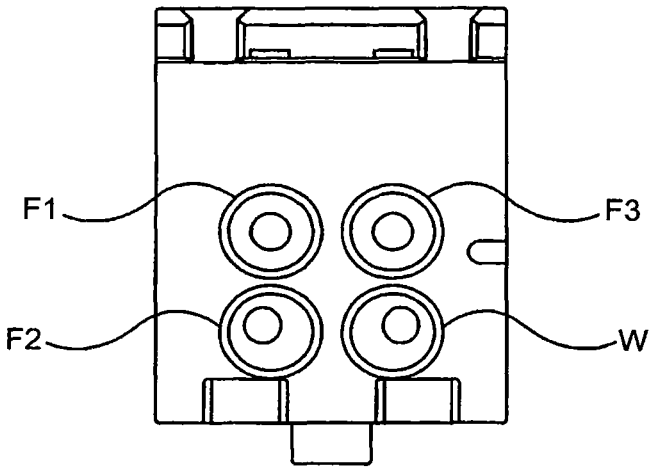
FIGS. 5A and 5B respectively depict the water and syrup inlets and outlets at the rear and bottom of the valve body of the present invention.

In a preferred embodiment of the present invention, a multi-flavor valve is provided that allows three non-carbonated beverage flavors to be dispensed by a beverage dispenser, with less cost and manufacturing complexity.

Among other features, the nozzle and diffuser of the multi-flavor valve are configured to permit the selected beverage's syrup concentrate (for example, iced tea syrup) and water to mix below and outside the nozzle. The valve flushes the nozzle and diffuser with water at the end of each dispensing operation, thereby substantially reducing any carryover of flavor and/or color between dispensations of beverages of different flavors.

In addition, the multi-flavor valve is preferably made with a single piece injection-molded valve body, thus minimizing secondary machining operations normally found in current two-flavor valves. Further, the diffuser creates a uniform and aesthetic flow from the nozzle. Adjustable ceramic flow control modules provide manual brixing control, and maintain the brix ratio by stabilizing water and syrup flow rates during fluctuations in the water and syrup pressures. Wet coil solenoid valves ("solenoids") open and close the valve's water and syrup flow paths to the nozzle, allowing the water and syrup to be dispensed. The valve's front cover includes a membrane switch for flavor selection, with LEDs to indicate the selected flavor. A modular, software-controlled electronics module accepts the flavor selection input and controls actuation of the solenoids. The valve's mounting block allows the valve to be mounted on existing dispensers (e.g., a drop-in dispenser or a countertop dispenser). The multi-flavor valve may be assembled within a standard-sized one-flavor valve package, for example, a valve package having similar dimensions as a OF-1 valve package, to maintain a consistent dispenser appearance.

The cost of manufacturing the multi-flavor valve of the present invention can be less than that of a conventional two-flavor valve, primarily because manufacturing a single piece injection molded valve body costs less and can be done faster and with less labor than machining and laminating together multiple body layers, as done in existing valves. Consequently, additional beverage flavors (even beyond that of the two-flavor valve) can be economically added to an existing beverage dispenser, usually at a fraction of the cost of adding second and third one-flavor (dedicated) dispensers. In addition, because a single dispenser may still be used, counter space is saved, and beverage dispensing operator efficiency is increased.

The multi-flavor valve 180 (see, e.g. FIGS. 18A-18D) maybe variously configured, as discussed in more detail below, for different applications. In all configurations, the operator presses one of the four flavor selection switches (flavored beverage switches 181 or water-only switch 182) on a switch membrane. This selection causes the corresponding LED 186 to light. Depending on the configuration, the selected syrup solenoid and the water solenoid are activated, opening the corresponding syrup and water flow paths to the nozzle (unless the water-only button 182 is pressed, in which case only the water solenoid is activated). At the end of dispensing, caused by whichever means described below, the syrup solenoid is deactivated, closing the syrup flow path to the nozzle, while the water solenoid remains activated, allowing water to flush the nozzle and diffuser of most, if not all, of the remaining syrup. This leaves the nozzle and diffuser substantially free of syrup for the next dispensation, thus preventing flavor and/or color carryover therebetween.

The various valve configurations include an autofill model, a sanitary lever model, a self-serve model, and a portion-control model, as respectively shown in FIGS. 18A-18D. While the valve will be described in detail in relation to these four configurations, it is to be understood that these configurations are by way of illustration only, and the scope of the present invention is not limited by their details. Further, the valve is not limited to dispensing three beverage flavors, but may be modified by those skilled in the art to dispense a different number of beverage flavors.

The autofill model (FIG. 18A) allows an operator to actuate the valve (and the appropriate water/syrup solenoids) by placing a cup against the dispensing lever 184. In this configuration, the portioning is automatically controlled by an integrated liquid level sensor circuit (discussed in more detail below). In operation, the valve continues to dispense the selected beverage into, e.g., an insulated cup (not shown) until the cup is filled and the beverage just begins to overflow, after which the valve stops dispensing. If the valve is being used for carbonated beverages, one or more (optional) topping-off cycles may also be programmed into the autofill control software. A topping-off cycle allows foam (or the like) created in the initial fill to settle for a short time thereafter, when the valve is automatically reactivated and the cup begins to fill again, until the beverage overflows from the cup again. The autofill mechanism, with or without topping-off cycles, allows the operator to leave a cup, regardless of its size or the amount of ice therein, unattended while it is filling, allowing the operator to do other tasks. The autofill dispensing operation can be manually canceled, that is, before the valve automatically stops dispensing by removing the cup from the lever. Topping-off may alternatively be accomplished in the autofill model by manually removing the cup from the dispensing lever, and replacing it against the dispensing lever to reactivate the valve.

The sanitary lever model (FIG. 18B) has an offset, or sanitary, lever 185 which allows the operator to actuate the valve (and the appropriate water/syrup solenoids) manually by placing and holding the cup against the lever. The valve continues to dispense the selected beverage into the cup until the operator removes the cup from the dispensing lever. In this configuration, the beverage portion is manually controlled by the operator.

The self-serve model (FIG. 18C) allows the operator, usually but not necessarily a restaurant customer rather than employee, to actuate the valve (and the appropriate water/syrup solenoids) by pressing one of beverage flavor switches 181/182. The valve continues to dispense the selected beverage as long as the operator continues to press the flavor switch. In this configuration, the operator needs only to press one switch for operation, making it convenient for self-service. The operator may also mix flavors, if desired, by pressing a second flavor switch after releasing the first flavor switch. That is, pressing more than one flavor switch will not result in multiple beverage flavors being simultaneously dispensed—the valve is normally configured to allow only the first pressed switch to determine the dispensed beverage flavor.

The portion-control model (FIG. 18D) allows the operator to actuate the valve (and the appropriate water/syrup solenoids) by pressing one of the preprogrammed portion size switches 183*a*, 183*b*, 183*c*, or 183*d*, preferably located (see FIG. 18D) below the beverage flavor switches on the switch membrane. These switches may respectively correspond to small (12 ounce), medium (16 ounce), large (24 ounce) and extra-large (32 ounces) portion sizes (see also switches 70 of FIG. 15B, described in further detail below). This causes the valve to dispense the selected beverage for a predetermined period of time (seconds) at a predetermined dispensing flow rate (ounces per second), thereby dispensing a corresponding predetermined beverage volume (ounces). When dispensing, the dispensation cycle may be manually canceled by pressing a top-off/cancel switch 183*e*, preferably located below the portion size switches on the switch membrane. When not dispensing, the valve may be manually actuated (for filling or for topping off) by pressing the top-off/cancel switch (see also top-off/cancel switch 72 of FIG. 15B). In this case, the valve will continue to dispense as long as the top-off/cancel switch is pressed.

Preferably, the multi-flavor post-mixing valve of the present invention dispenses three different-flavored, non-carbonated beverages and water. Alternatively, the valve may be configured to dispense three carbonated beverages and, if desired, carbonated water. According to a preferred embodiment, the multi-flavor valve includes the following major components, each of which will be discussed in further detail below: a single piece injection-molded valve body (which contains three syrup flow paths and one water flow path), four solenoids (three for opening and closing corresponding syrup flow paths to the nozzles, and one for opening and closing a water flow path to the nozzle), four flow control modules (three for syrup and one for water), a software-controlled electronic circuit board module ("electronic module"), a portion control membrane switch (optional), a flavor panel membrane switch, a nozzle, a diffuser, a base plate, a mounting block, and a valve cover.

Figure 17:
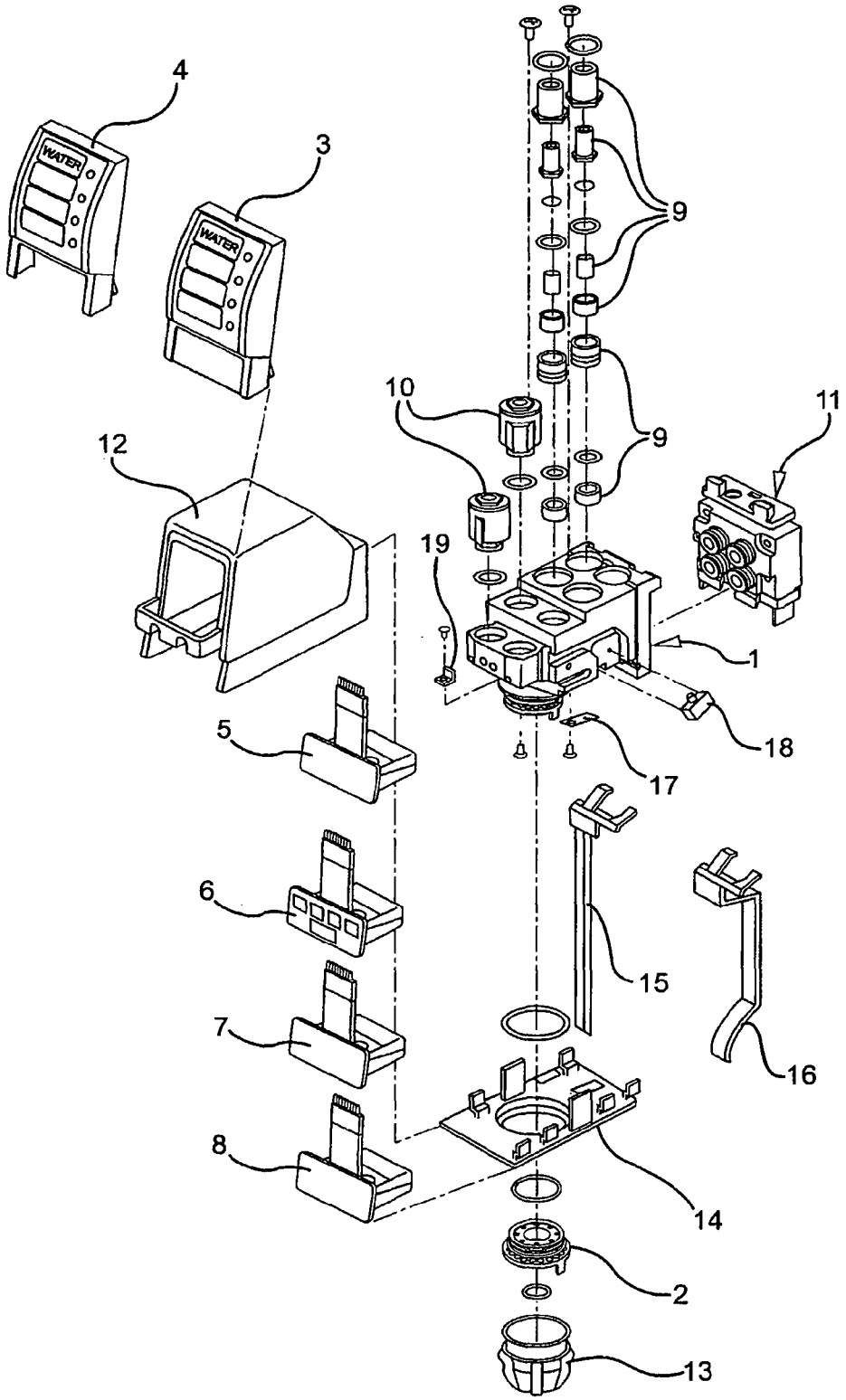
FIG. 17 provides an exploded view of the multi-flavor valve assembly of the present invention.
Figure 18A:
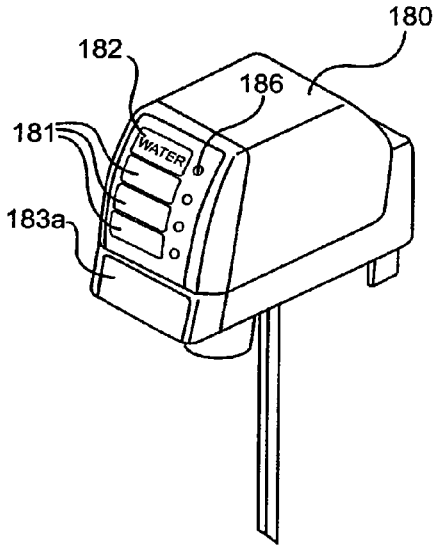
FIGS. 18A-18D respectively depict autofill, sanitary lever, self-serve, and portion control configurations of the multi-flavor valve of the present invention.
Figure 18B:
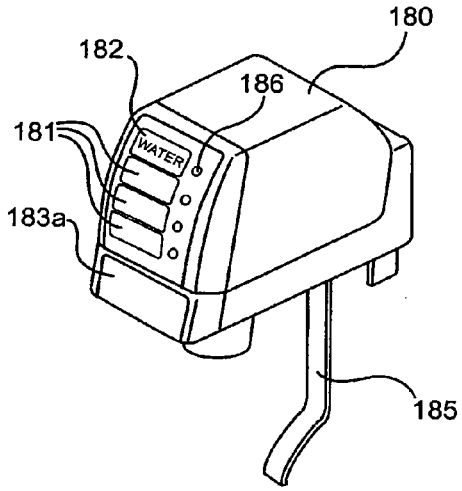
Figure 18C:
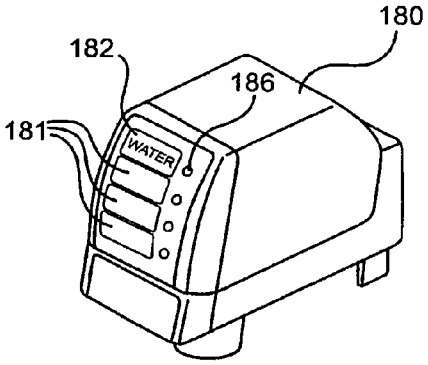
Figure 18D:
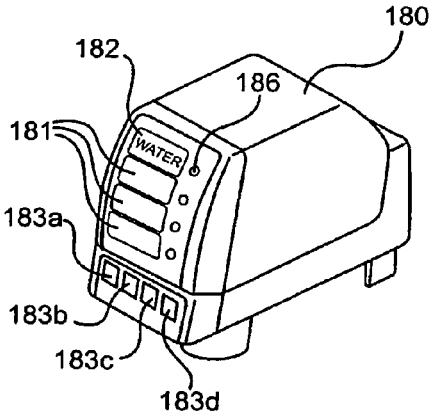

FIG. 17 illustrates an exploded view of a multi-flavor valve assembly of the present invention, which can be modified with respect to the configuration models described herein (e.g., autofill, sanitary lever, self-serve, and portion control). The three-flavor variety valve of these examples is the same size as a standard one-flavor valve, and can therefore fit into space normally allotted for the standard one-flavor valve on most dispensers. By virtue of the features disclosed herein, flavor and color transfer between dispensations of different flavored beverages can be minimized.

The valve generally includes a valve body 1, a diffuser 2, a front cover 3 (for the autofill, sanitary lever, and self-serve models), a front cover 4 (for in the portion-control model), electronic module 5 (for the autofill model), electronic module 6 (for the portion-control model), electronic module 7 (for the sanitary lever model), electronic module 8 (for the self-serve model), flow control modules 9, solenoids 10, a mounting block assembly 11, a rear cover 12, a nozzle 13, a base plate 14, a lever 15 (for the autofill model), a sanitary lever 16 (for the sanitary lever model), a lever spring 17 (used in the autofill and sanitary lever models for returning the lever 15 or 16 back to its normal position when the operator removes a cup that is being pressed against it) and lever switch 18 (used in the autofill and sanitary lever models for detecting when a cup is pressed against the lever 15 or 16, thereby putting the valve in an "on" state, and for detecting when the cup is removed from the lever, thereby putting the valve in an "off" state), and a nozzle probe 19 (for the autofill model).

The flow control modules 9 are inserted into the valve body 1 and preferably secured with retaining washers and machine screws. The solenoids 10 are threaded directly into the valve body 1. The switch 18 (for the autofill and sanitary lever models) is preferably fastened to the valve body 1 with machine screws. The lever spring 17 (for the autofill and sanitary lever models) is preferably fastened to the valve body 1 with a machine screw. The nozzle probe 19 (for the autofill model) is preferably fastened to the valve body 1 with a machine screw. The autofill lever 15 (for the autofill model) and the sanitary lever 16 (for the sanitary lever model) are inserted into the base plate 14. The base plate 14 clips onto the valve body 1. The diffuser 2 is inserted over the valve body syrup tube and into a pocket on the valve body 1. The nozzle 13 is screwed into the base plate 14.

Figure 21:
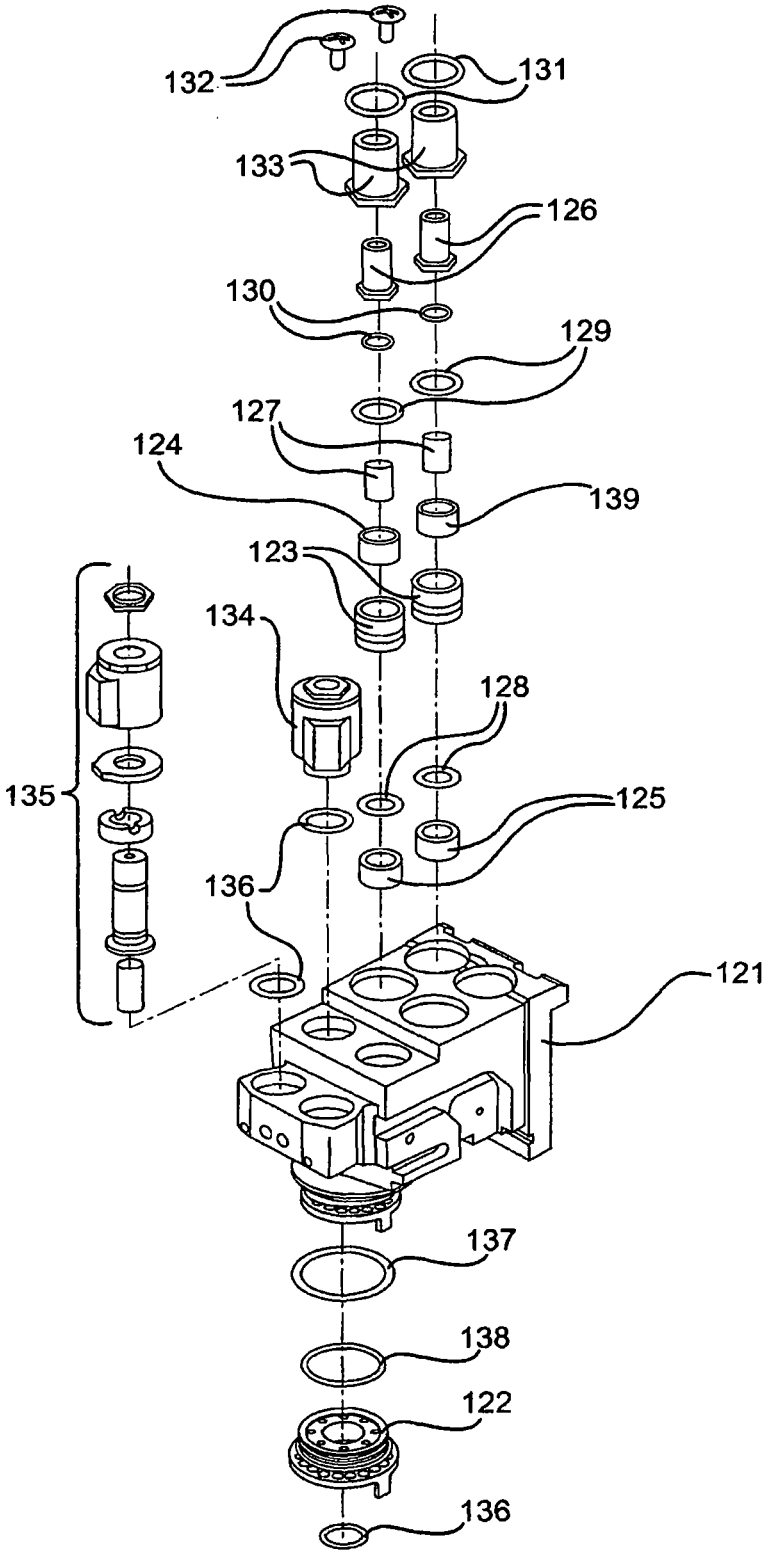
FIG. 21 provides an exploded view of the multi-flavor valve sub-assembly of the present invention.

FIG. 21 illustrates a more detailed exploded view of the valve body assembly, showing a valve body 121, a diffuser 122, a cylinder 123, a piston (water) 124, a spacer 125, an adjustment screw 126, a spring 127, an O-ring 128 for the spacer 125, an O-ring 129, an O-ring 130 for the adjustment screw 126, a washer 131, machine screws 132, a top 133, a solenoid assembly 134 with connector (syrup), a solenoid assembly 135 with connector (water), O-rings 136, 137, and 138, and a piston 139 (syrup).

Figure 15A:
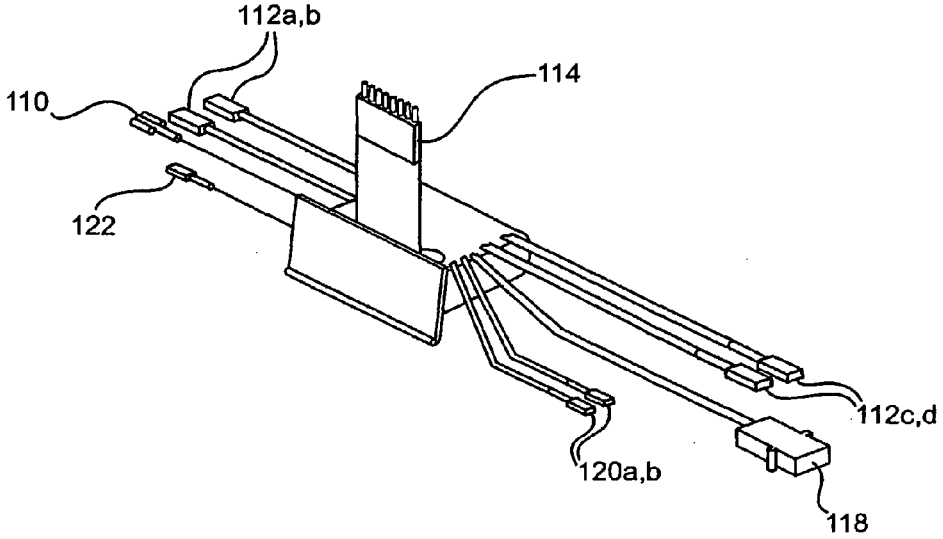
FIGS. 15A-15B illustrate the electronics module of the multi-flavor valve of the present invention.

Returning to FIG. 17, the electronic module (5, 6, 7, or 8) is slid into the base plate 14 (see, e.g., FIG. 15A for interconnections). The rear cover 12 is slid over the rear portion of the assembly and clips onto the base plate 14. The front cover 3 (for the autofill, sanitary lever, or self-serve model) connects to the electronics module (respectively 5, 7, or 8) and clips onto the front of the rear cover 12. The front cover 4 (for the portion-control model) connects to the portion control electronics module 6 and clips onto the front of the rear cover 12, exposing the portion control switch membrane (see FIG. 15B).

Figure 14A:
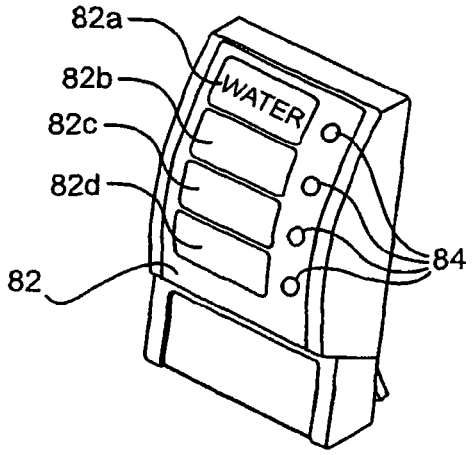
FIGS. 14A-14C respectively provide perspective, front, and side views of the front cover of the multi-flavor valve of the present invention.
Figure 14B:
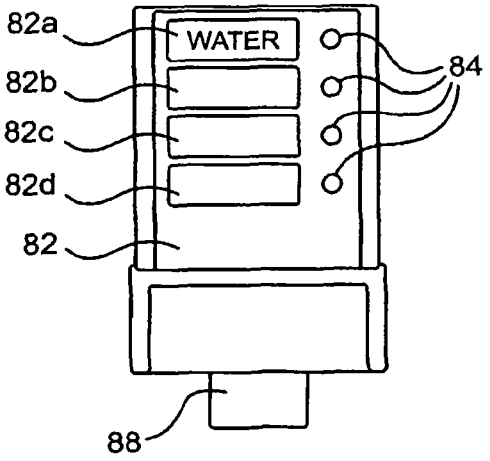
Figure 14C:
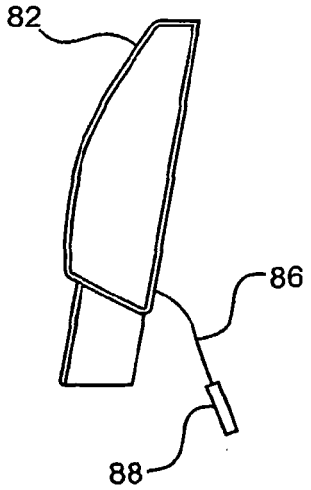
Figure 15B:
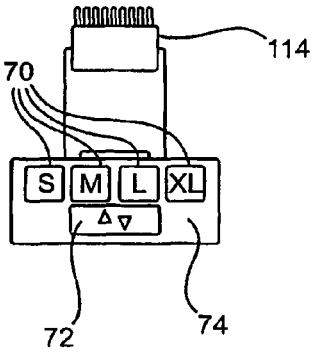

The operator selects a flavor by pressing that flavor's corresponding switch, which may be identified by a label, on the valve's front cover. FIG. 14A-14C illustrate one type of valve front cover 3, on which three different beverage flavors and water are identified. A flavor key selection pad or switch membrane 82 on the front of the valve identifies the available beverage flavors and water, thereby allowing for operator flavor selection. In this example, the switch membrane 82 includes flavor switch 82*a* for water and switches 82*b*, 82*c*, 82*d* for three other flavors. LEDs 84 (light-emitting diodes) correspond to each flavor switch to indicate the current flavor selection. The flavor switch can be used to either select, or to select and dispense in the self-serve configuration one of the three flavors or water. The key pad/switch membrane is assembled to a standard front cover, and the front cover attaches to a standard rear cover. The front cover 4 is connected to electronics module 5, 7, or 8 (FIG. 15A) through a flexible ribbon circuit 86 and connector 88. Front cover 4 has a similar flavor switch configuration, and is similarly connected to portion control electronic module 6 (FIG. 15B).

FIG. 1 illustrates a top view of the valve body 1, assembled to a mounting block 20. The valve 1 of this example is a one-piece injection-molded valve body. Critical and/or non-injection-moldable features are machined subsequent and secondary to the molding process. The letter designations indicate water (W) and the three different flavors of syrup in this example (F1, F2, and F3). The valve body 1 includes separate flow paths for water W and each of the three syrup flavors (F1, F2, and F3). The valve body 1 also contains integrated flow control module cavities 22 and solenoid cavities 24, located as shown, in which the flow control modules 9 and solenoids 10 are respectively positioned.

FIG. 2 illustrates the bottom of the valve body 1, assembled to the mounting block 20. The letters indicate where water W and the three flavors of syrup (F1, F2, and F3) exit the valve body 1, the syrup through centrally positioned (in relation to the diffuser and nozzle) syrup tube 32. Each syrup exits the syrup tube 32 through a dedicated flow path, thus minimizing crossover of flavor and color between dispensations, as explained in more detail below.

FIG. 3 illustrates a rear view of the valve body 1, not assembled to the mounting block 20. This view shows upper dovetail slots 26 for mounting the valve body 1 onto the mounting block 20, and shows the channels 28 which permit flow out of the flow control module cavities.

FIG. 4 illustrates a bottom view of the valve body 1, not assembled to the mounting block 20, and shows lower dovetail slots 30 for mounting the valve onto the mounting block 20.

Figure 20:
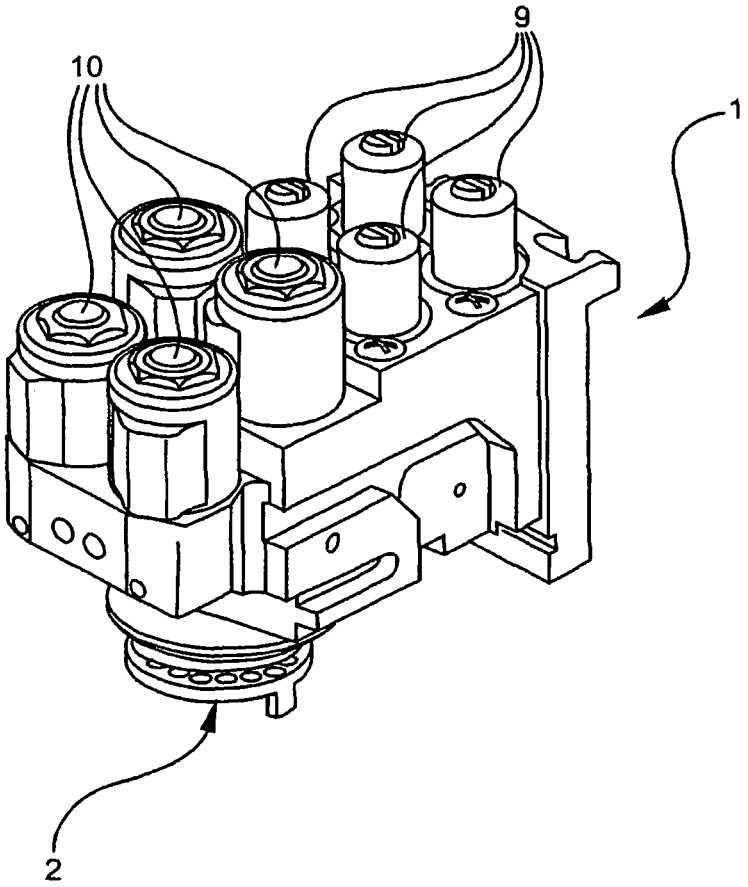
FIG. 20 provides a perspective view of the multi-flavor valve sub-assembly of the present invention.

FIG. 20 illustrates another view of the valve body 1, not assembled to the mounting block 20, with solenoids 10 positioned in the solenoid cavities 24, and flow control modules 9 positioned in the flow control module cavities 22.

Figure 5B:
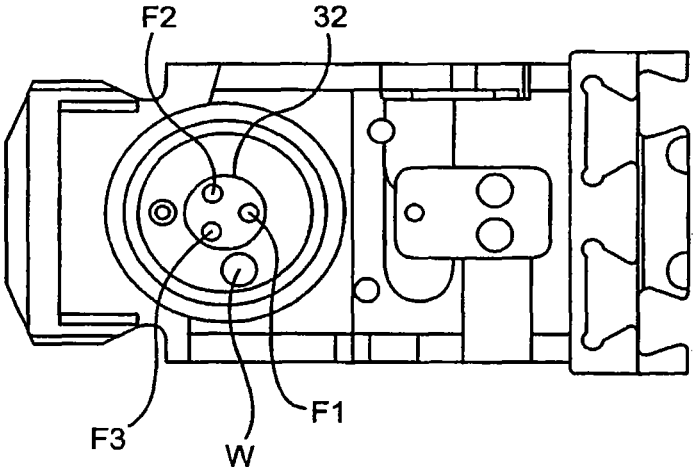
Figure 6A:
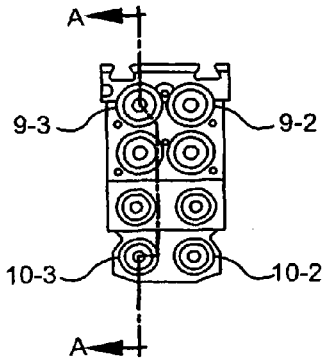
FIGS. 6A-6D depict the flow paths of syrup F3 and F2 in the multi-flavor valve of the present invention.
Figure 6B:
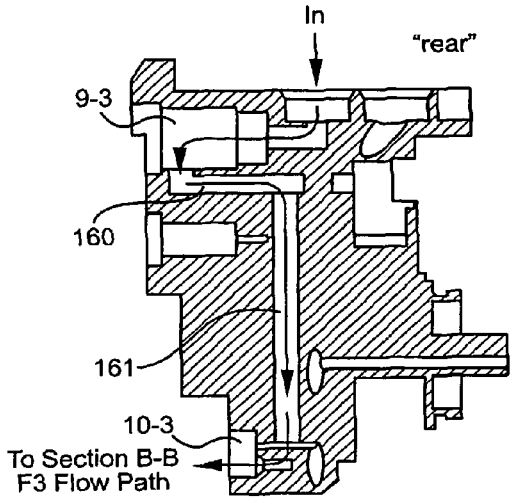
Figure 6C:
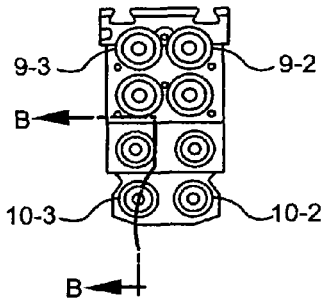
Figure 6D:
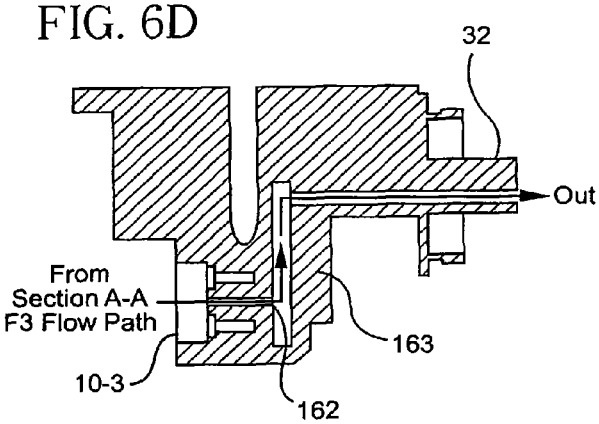

FIGS. 5A and 5B respectively illustrate the water/syrup flow path inlets at the rear, and the water/syrup flow path outlets at the bottom, of the valve body 1. Water and syrup enter the rear side of the valve 1 (see FIG. 5A), from respective openings in the mounting block 20, and out through the bottom front of the valve (see FIG. 5B). In particular, F1, F2, and F3 flow out of syrup tube 32 as shown in FIG. 5B. Water exits the hole "W" into the diffuser 2 (see FIG. 16C). The syrups and water are supplied by the dispenser to the openings in the mounting block 20 in a fashion well known to those skilled in the art.

FIGS. 6A-6D illustrate the flow path for a particular syrup F3. The syrup F3 flows in through the rear side of the valve body 1, through the flow control module 9-3 (see also FIG. 9, discussed below), through channels 160 and 161 into the solenoid 10-3 (see also FIG. 10, discussed below), through the solenoid cavity orifice 162 and channel 163, and exits through the bottom of the valve body 1 via the syrup tube 32. The flow of syrup F2 is symmetrical to F3, and instead involves flow control module 9-2 and solenoid 10-2.

Figure 7A:
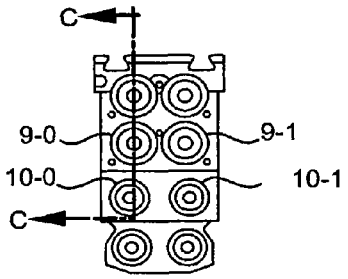
FIGS. 7A-7B depict the flow path of water in the multi-flavor valve of the present invention.
Figure 7B:
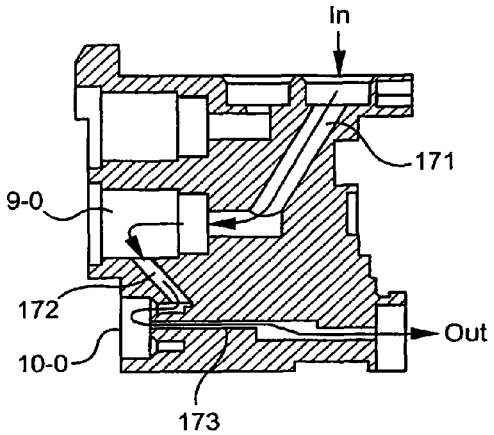
Figure 7C:
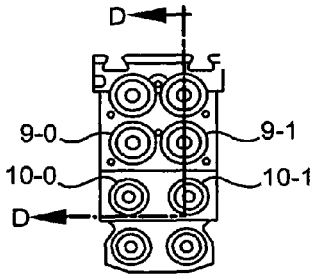
FIGS. 7C-7D depict the flow path of syrup F1 in the multi-flavor valve of the present invention.
Figure 7D:
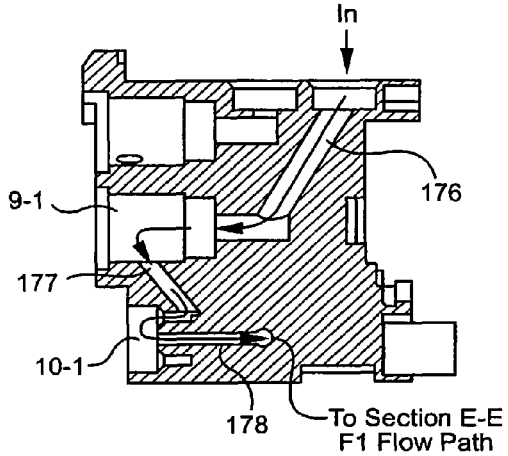
Figure 9A:
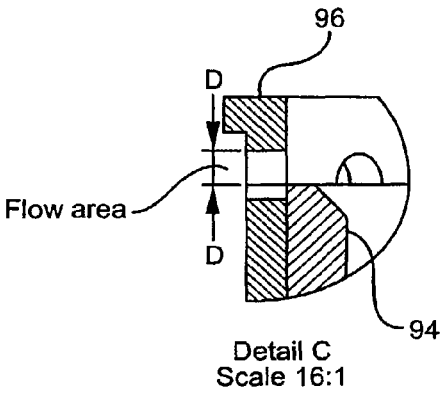
FIGS. 9A-9E illustrate the flow control module of the multi-flavor valve of the present invention.
Figure 9B:
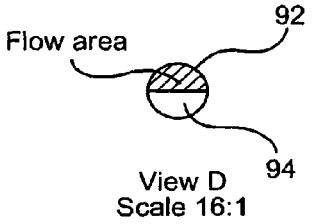
Figure 9C:
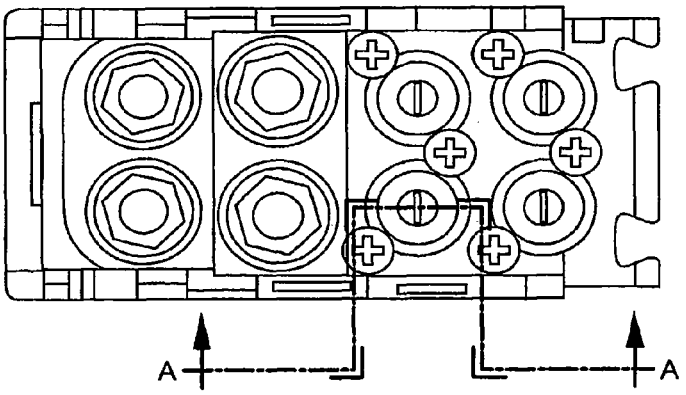
Figure 9D:
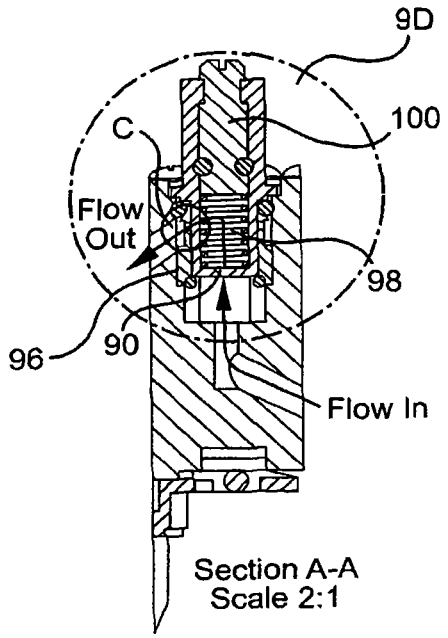
Figure 9E:
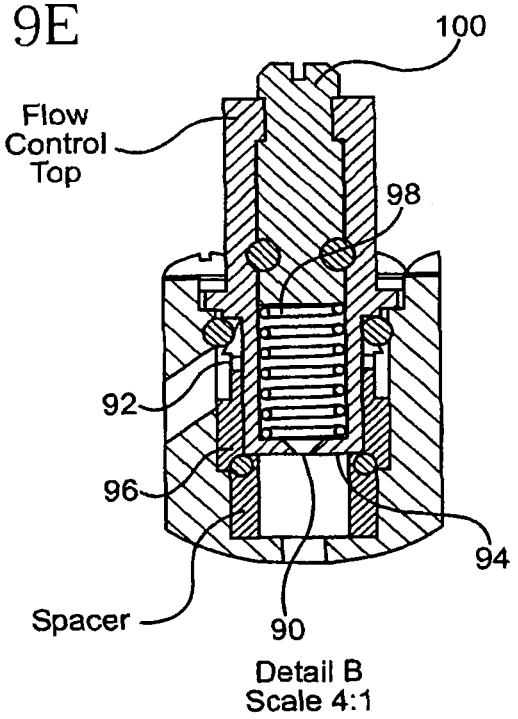

FIGS. 7A and 7B illustrate the water W flow path, and FIGS. 7C, 7D, 8A and 8B illustrate the syrup F1 flow path. Water W flows in through the rear of the valve body 1, through channel 171 into flow control module 9-0, through a channel 172 into the solenoid valve 10-0 (FIG. 10), through the solenoid cavity orifice 173, and exits through a hole in the bottom of the valve body 1 into the diffuser 2. The syrup F1 flows in through the rear of the valve body 1, through channel 176, into and through the flow control module 9-1, through channel 177 into the solenoid valve 10-1, through the solenoid cavity orifice 178, through channel 179, and exits through the bottom of the valve body 1 via the syrup tube 32.

FIGS. 9A-9E illustrate the flow through any one of the four flow control modules 9. Each flow control module 9 resides within the valve body's integrated flow control cavity 22. The flow control module 9 includes a ceramic piston 94, a ceramic cylinder 96, and a spring assembly 98. An adjustment screw 100 allows a serviceperson to manually adjust the water and syrup concentrate flow rates, and thus the brix. During valve operation, the flow control module compensates for fluctuations in the water and syrup concentrate supply pressures to maintain a nearly constant flow rate for each fluid. This is accomplished by varying the cylinder orifice flow area 92. As the fluid pressure of the water or syrup concentrate increases, the piston 94 is pushed upwards by the fluid pressure, and the cylinder orifice flow area 92 is reduced, reducing the flow rate. As the fluid pressure drops, the spring 98 pushes the piston 94 down, increasing the cylinder orifice flow area 92 and increasing the flow rate. The water and three syrups of this example each have a separate flow control assembly. Because water is less viscous than syrup, the water piston orifice is sized slightly larger than that of the syrup to provide an adequate water flow rate. The water and syrup cylinder orifices are substantially identically sized. As can be seen from FIGS. 9A-9E, flow enters through piston orifice 90 and exits through cylinder orifice 92.

Figure 10A:
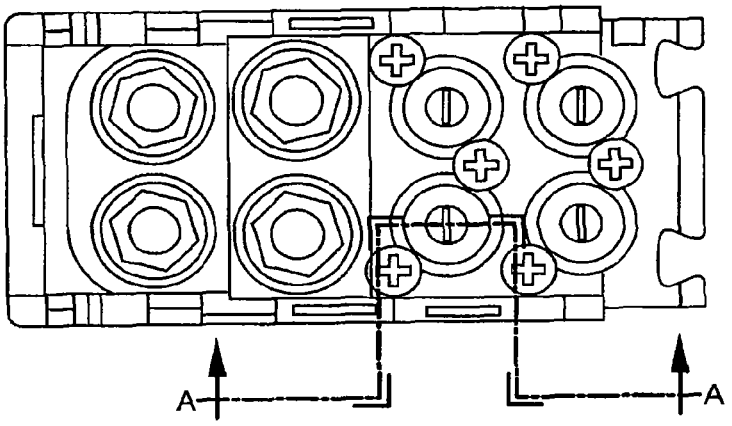
FIGS. 10A-10B illustrate the solenoid valve of the multi-flavor valve of the present invention.
Figure 10B:
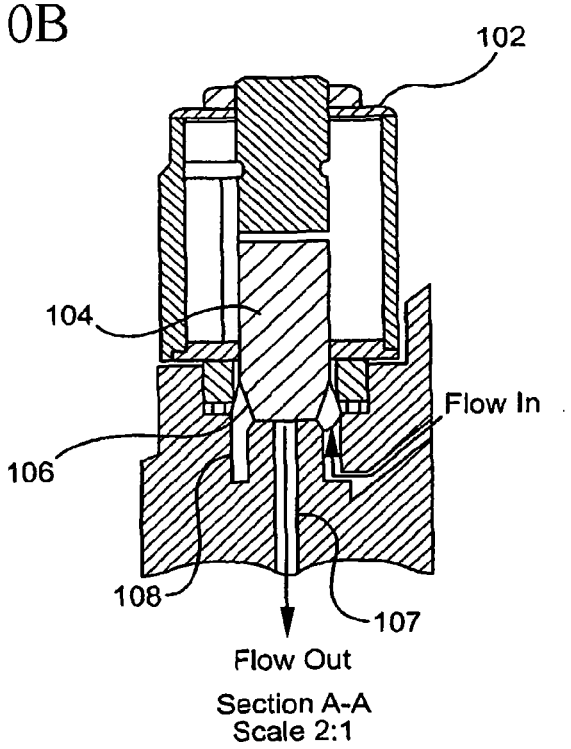
Figure 11A:
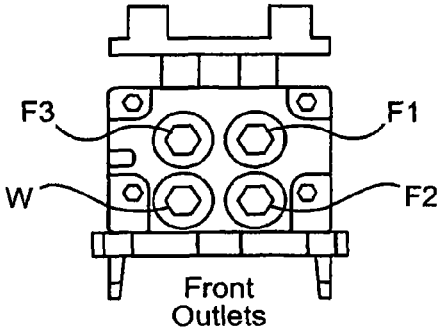
FIGS. 11A-11L depict the mounting block flow paths in the multi-flavor valve of the present invention.
Figure 11B:
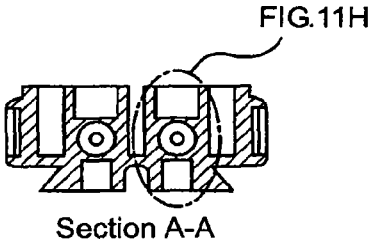
Figure 11C:
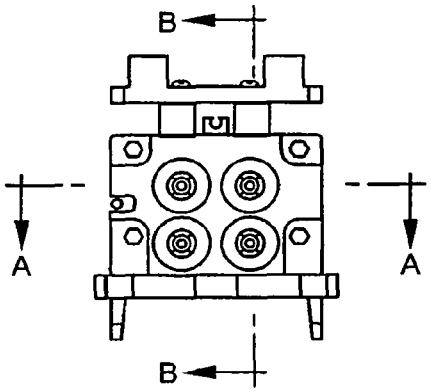
Figure 11D:
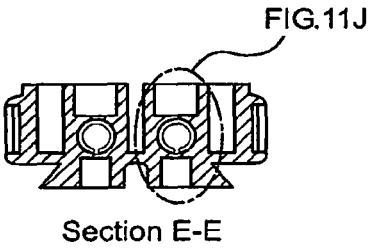
Figure 11E:
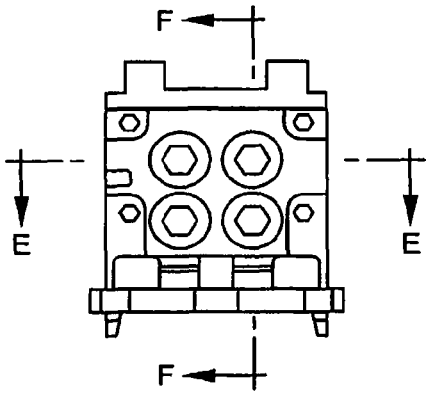
Figure 11F:
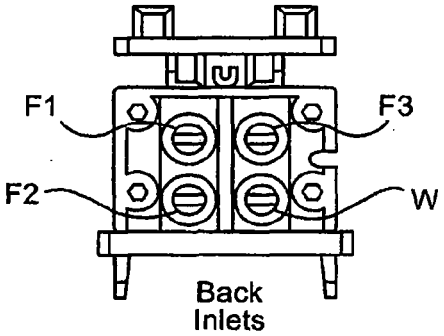
Figure 11G:
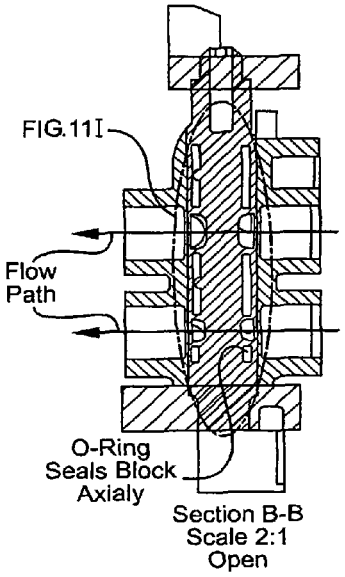
Figure 11H:
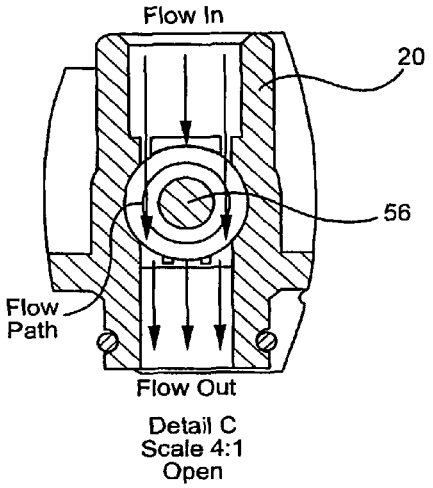
Figure 11I:
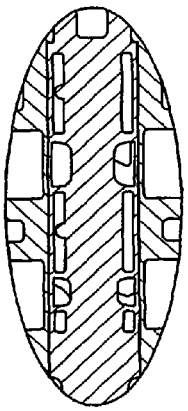
Figure 11J:
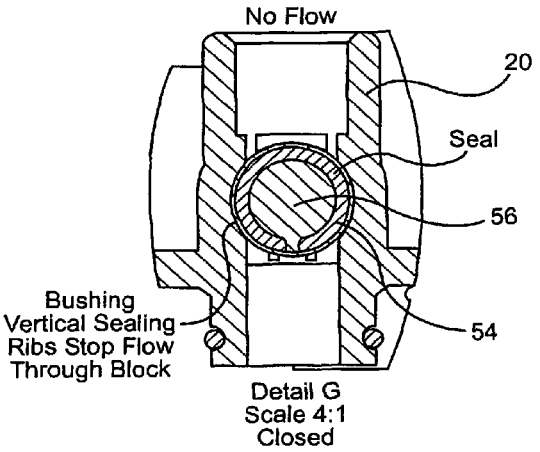
Figure 11K:
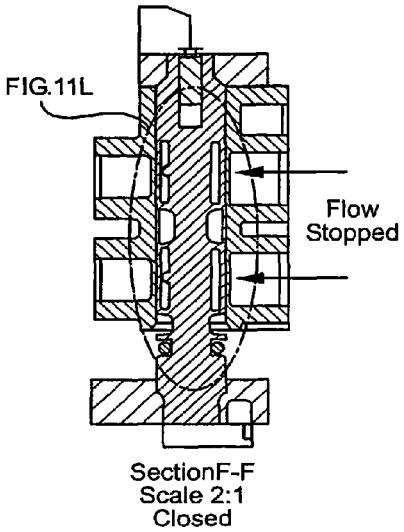
Figure 11L:
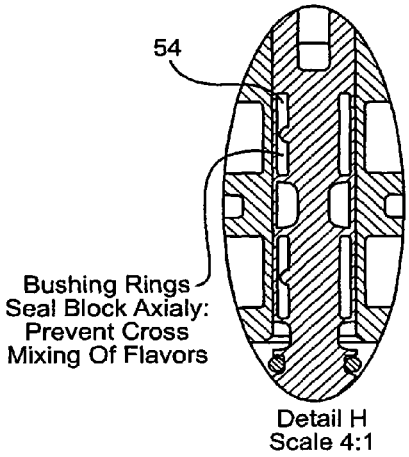

FIGS. 10A and 10B illustrate any one of the solenoid valves 10. The solenoid valve is threaded into the valve body's solenoid cavity 24. Water or syrup enter the solenoid cavity 24 and exits through the valve body's integrated solenoid orifice 107. The valve body 1 utilizes four solenoids to open and close flow paths, as determined by the selected flavor switch, to dispense water and none or one of the three syrups into the nozzle. The operator is a wet coil type. This means that the plunger 104 is exposed to the water or syrup, which cools the solenoid coil 102. The water or syrup enters the solenoid cavity 24. The orifice 107 is normally blocked by the plunger seal 106 of the plunger 104, and thus water or syrup cannot pass through the orifice 107. When the valve is actuated, the appropriate solenoid coils receive power, creating a magnetic field and causing the plunger 104 to be pulled upwards, in turn lifting the plunger seal 106 off the orifice mound 108 and allowing the water or syrup to pass through the orifice 107. The water solenoid coil preferably has an impedance of 26Ω, and each of the syrup coils preferably have an impedance of 100Ω.

Figure 13A:
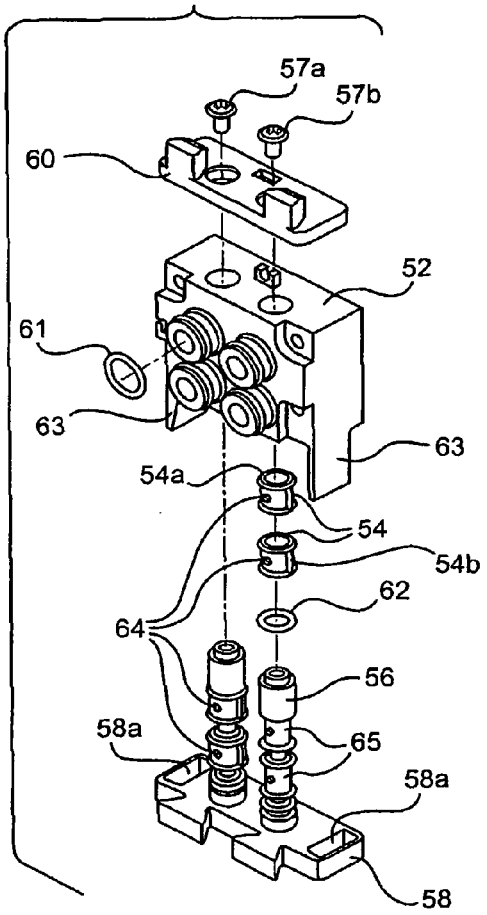
FIG. 13A provides an exploded view of the mounting block of the multi-flavor valve of the present invention.
Figure 13B:
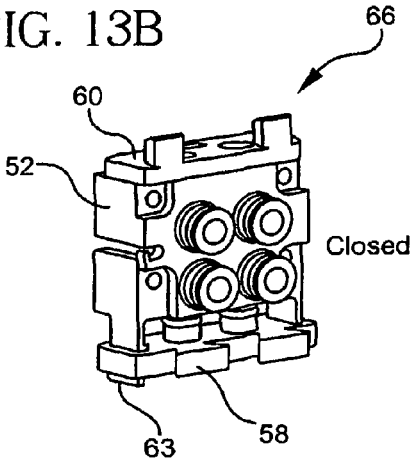
FIGS. 13B and 13C respectively illustrate closed and opened mounting block positions of the multi-flavor valve of the present invention.
Figure 13C:
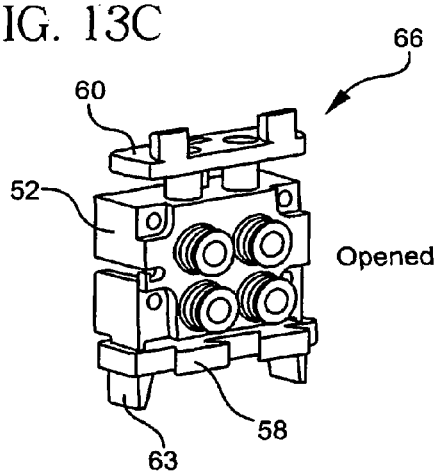

FIGS. 13A-13I illustrate mounting block 20. An exploded view is shown in FIG. 13A.

The valve mounting block 20, normally attached to the dispenser, allows the valve body 1 to be mounted on existing dispensers (e.g., drop-in dispensers or countertop dispensers). The mounting block 20 of this embodiment is the same size as a standard one-flavor mounting block and generally requires only about 30% more force for valve removal, despite sealing twice the amount of pressure (that is, sealing one water line and three syrup supply lines) as a standard one-flavor mounting block (that is, sealing one water line and one syrup line). The illustrated mounting block has three syrup ports and one water port.

Figure 12A:
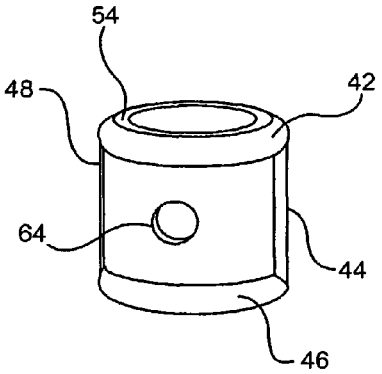
FIGS. 12A-12E illustrates the bushing seal utilized by the mounting block of the multi-flavor valve of the present invention.
Figure 12B:
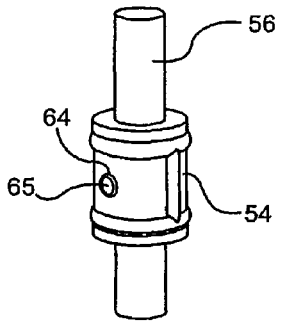

The mounting block 20 includes a mounting block body 52, spindles 56, bottom support 58, top support 60, o-rings 61 and 62, alignment tabs 63, and bushing seals 54 (54*a* and 54*b*). The spindles 56 are preferably sonic-welded into the bottom support 58. The bushing seals 54*a* and 54*b* are installed over the spindles 56 and are indexed by an indexing hole 54 on the bushing seal (see FIG. 12A) corresponding to shaft boss 65 on the spindle (shaft) 56 (see FIG. 12B). The spindles 56 are inserted into the mounting block body 52. The alignment tabs 63 of the mounting block body 52 removably attach to the bottom plate 58 via openings 58*a*. The top support 60 is fastened to the spindles 56 with thread forming screws 57*a* and 57*b*. The spindles 56, bottom support 58 and top support 60 form a movable spindle assembly 66.

The mounting block contains spindle alignment mechanism that properly aligns the spindles within the mounting block body. As the block is closed, bottom support and spindles move downward. The bottom support is pushed back to the rear by the alignment tabs, and consequently the spindles are pushed back to provide proper spindle alignment and sealing.

Figure 13D:
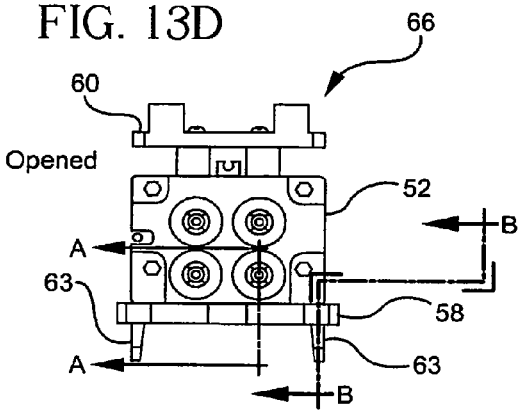
FIGS. 13D-13F illustrate, in more detail, the opened mounting block position.
Figure 13E:
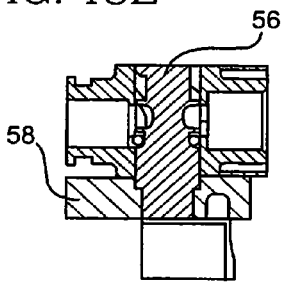
Figure 13F:
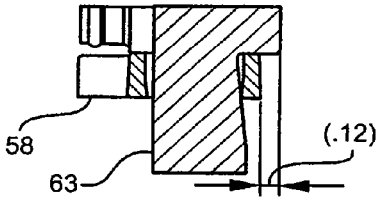
Figure 13G:
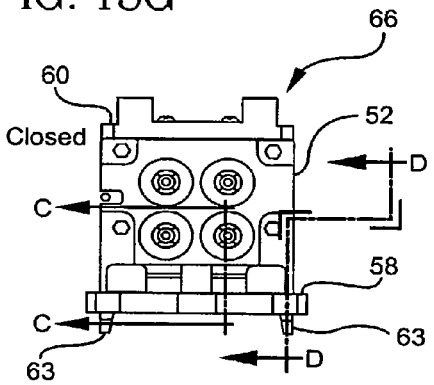
FIGS. 13G-13I illustrate, in more detail, the closed mounting block position.
Figure 13H:
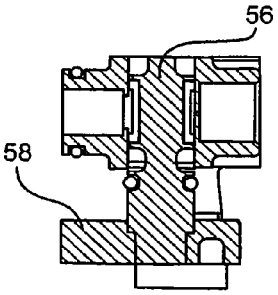
Figure 13I:
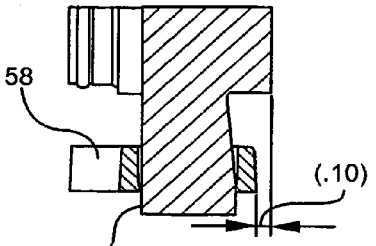

As mentioned above, the mounting block 20 is assembled onto the dispenser to accommodate mounting of the multi-flavor valve. When the mounting block 20 is closed by lowering the movable spindle assembly 66 (FIG. 13B), the water and syrup concentrate supply lines are pressure sealed by the bushing seals 54, allowing the valve to be mounted or dismounted from the dispenser. After the valve is mounted to the mounting block, the mounting block may be opened. The mounting block is opened by raising the movable spindle assembly 66 (FIG. 13C), allowing the water and syrup concentrates to flow through the spindle openings 64 to the rear of the valve body 1. FIGS. 13D-13F illustrate, in more detail, the opened mounting block position, and FIGS. 13G-13I illustrate, in more detail, the closed mounting block position. These figures illustrate, in particular, the internal flow paths of the mounting block for the three syrups F1, F2, F3 and Water and the manner in which the bushing seal provides sealing.

The valve body 1 is secured onto the mounting block 20 by upper and lower dovetail slots (26, 30) projecting from the top and bottom spindle supports. When the mounting block 20 is closed, the valve body 1 may be mounted onto the mounting block 20; pushing the spindle assembly upwards secures the valve body 1 to the mounting block 20 while simultaneously opening the flow through the mounting block 20. Once the valve body 1 has been mounted on the mounting block 20, it cannot be removed unless the mounting block is closed and the water and syrup concentrate supplies are shut off.

FIGS. 12A-12E illustrate details of bushing seal 54. The o-ring seals 42, 46 prevent leakage out of the mounting block 20 and cross-mixing of flavors within the mounting block 20. The sealing ribs 44, 48 stop flow through the mounting block 20 when the mounting block 20 is closed. An indexing hole 64 provides the proper orientation of a bushing seal when it is installed on a spindle shaft 56, via alignment with a shaft boss 65 on the spindle shaft, as shown on FIG. 12B, and maintains proper orientation during operation.

Figure 12C:
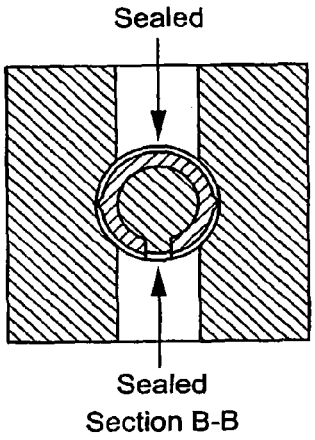
Figure 12D:
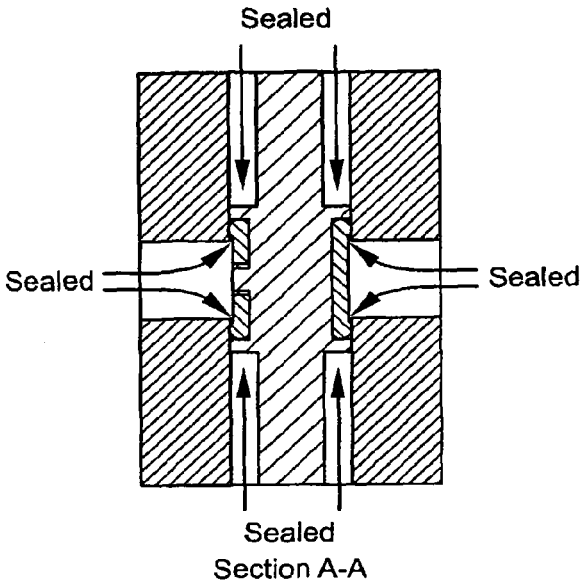
Figure 12E:
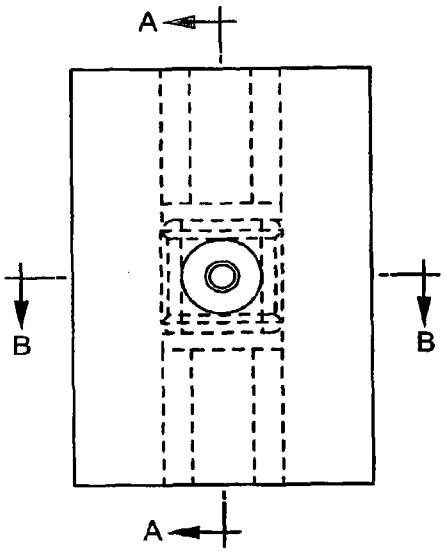

FIGS. 12C-12E illustrate the sealing by the bushing seal. The bushing seal is multi-directional, and thus can simultaneously seal vertically and horizontally, as shown, to prevent flow or leaks in both directions. The o-rings seals on the bushing seal prevent flow in the axial direction and the sealing ribs prevent flow in the horizontal direction. As discussed above, the bushing seal contains an index hole that maintains the angular relation with the shaft.

FIGS. 11A-11L illustrate various views of the mounting block 20 flow paths. Water and syrup enter the mounting block 20 from the back inlets and exit the mounting block 20 into the valve body 1 through the front outlets. When the mounting block 20 is closed, the bushing seals 54 stop flow through the mounting block 20 and prevent leakage from the mounting block 20. When the mounting block is opened, flow is allowed through the mounting block 20, and the bushing seals 54 prevent cross mixing of the water and syrup flavors. The mounting block bushing seals 54 in this example are lubricated with high performance grease that does not wash off, which, combined with spindle openings 64 constructed by less than 0.1 degrees of draft in this example, provides ease of valve mounting and removal.

Figure 16A:
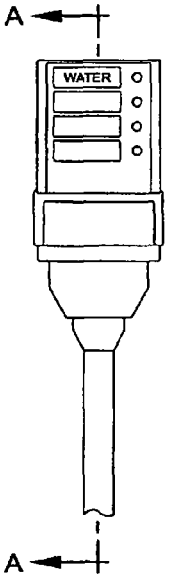
FIGS. 16A-16C illustrate the nozzle and diffuser configuration of the multi-flavor valve of the present invention.
Figure 16B:
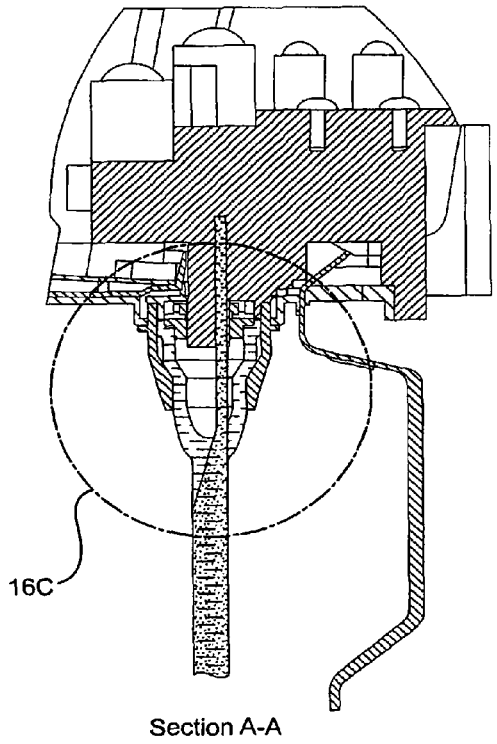
Figure 16C:
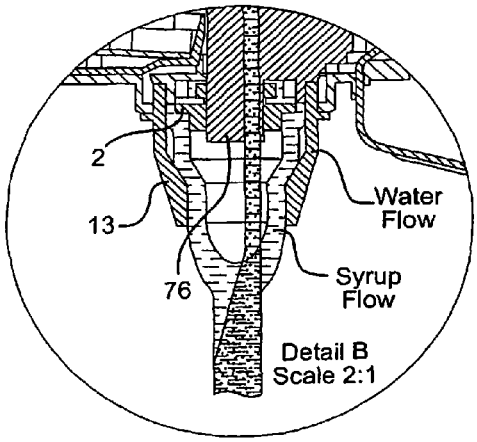

FIGS. 16A-16C illustrate the nozzle 13 and diffuser 2 configuration of the valve body 1. FIG. 16A illustrates a front cover and the nozzles, etc., while FIG. 16B is a cross section of FIG. 16A along A-A, and FIG. 16C is an enlarged view of the circle in FIG. 16B. Water exits the valve body 1 above the diffuser 2, flows through the diffuser 2, and out of the nozzle 13. The syrup concentrate exits the valve body 1 from the syrup spout 76 and flows straight down, central to the water flow. The water and syrup concentrate mix just below the outlet of the nozzle 13.

Figure 19A:
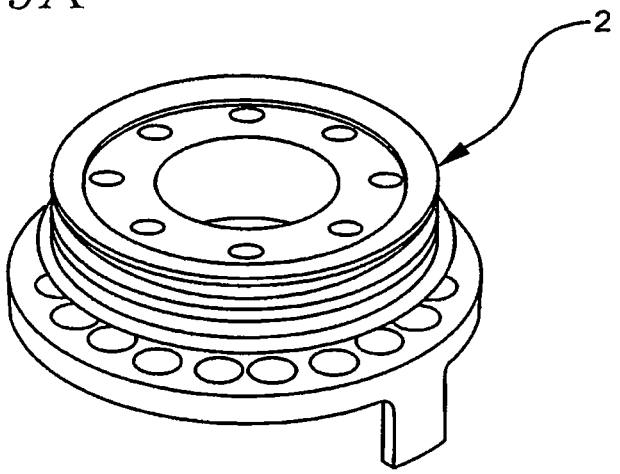
FIGS. 19A-19B respectively provide perspective and bottom views of the diffuser of the multi-flavor valve of the present invention.
Figure 19B:
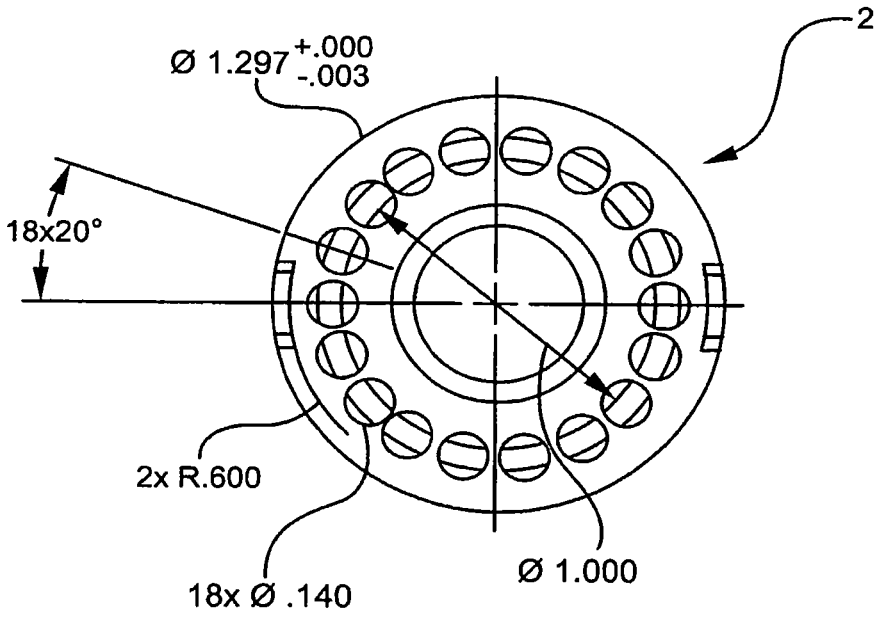

The injection-molded flow diffuser 2 also creates a uniform and aesthetic flow from the nozzle 13. FIG. 19A illustrates the diffuser 2 according to one embodiment, while FIG. 19B is a cross section of the bottom portion of the diffuser 2.

The valve outlets, diffuser 2, and nozzle 13 are configured so that flavor and color transfer between dispensing beverages of different flavors can be minimized. First, each syrup exits the syrup tube 32 through a dedicated flow path. In addition, the diffuser 2 controls the velocity of the water exiting the valve body 1 and isolates the water flow from the syrup tube 32. The syrup tube length, in relation to the water discharge distance from the diffuser, prevents water from accumulating on the tip of the syrup tube 32. Moreover, the surface tension of the syrup at the dispensing end of the syrup tube 32 substantially prevents syrup from dripping out of one of the syrup flow paths during dispensation of a beverage using another syrup, thereby minimizing flavor and color contamination of the dispensed beverage. In addition, the water flow and syrup flow separately to outside, below the nozzle 13 where they mix, thereby minimizing splashing of beverage within the nozzle 13. Also, after each dispensation, the nozzle is flushed with water to remove substantially any residual syrup on the nozzle.

FIG. 15A illustrates the valve electronics module (5, 7, or 8), which can vary in configuration according to the model employed. The valve electronics module (5,7, or 8) in this example includes a lever probe connector 110 (autofill module only) four solenoid connectors 112*a*, 112*b*, 112*c* and 112*d*, a front cover connector 114, a 24 VAC connector, lever switch connectors 120*a*, 120*b* (autofill and sanitary lever models only), and nozzle probe connector 122 (autofill only). The valve's multi-functional electronics may be contained in a valve electronics housing having similar dimensions as a standard (UF-1) housing. FIG. 15B illustrates the valve electronics module 6 for the portion-control model, and includes front cover connector 114, the four solenoid connectors 112*a-d* (not shown) and the 24 VAC connector 118 (not shown). As will be explained in further detail below, the electronics module controls inputs from the front cover flavor key pad or flavor switches (all models, via front cover connector 114), the portion control key pad (for the portion-control module), and the lever switch 18 (respectively for the autofill and sanitary lever models, via lever switch connectors 120*a* and 120*b*). The electronics module also controls actuation of and supplies power (received through the 24 VAC connector 118) to the solenoids 10 (via solenoid connectors 112*a*-112*d*), to control dispensation of the beverage. In the autofill model, the electronics module also supplies to and receives from the beverage a current, through the nozzle probe 19 (via nozzle probe connector 122) and the lever (probe) 15 (via lever probe connector 110).

As described, the software-controlled electronics module has a microprocessor which reads the inputs for the flavor switches 82*a*-82*d* on the front cover 3 or 4, and causes the LED 84 of the selected flavor to be lit. In the self-serve model, pressing one of the flavor switches is sufficient to actuate the appropriate solenoid(s) (water only, or water and the selected syrup flavor) and start dispensation. In the autofill and sanitary switch models, the microprocessor also reads the lever switch 17 closures when the operator presses the cup against the lever 15 or 16, which is sufficient to actuate the appropriate solenoids and start dispensation. In the portion-control model, the microprocessor instead reads the inputs from the portion control switches 70 or, if presently not dispensing, from the top-off/cancel switch 72, which is sufficient to actuate the appropriate solenoids and start dispensation.

In particular, when the valve is actuated to dispense, under software control, the microprocessor of the electronics module first causes the water solenoid to be opened, and then causes the syrup solenoid to be opened after a short delay (for example, 160 milliseconds in a preferred embodiment). This delay allows the water exiting from the nozzle to fully flow prior to the syrup entering the water stream, thus minimizing splashing of the dispensed beverage into the cup. When dispensing is stopped, either manually or automatically, the open syrup solenoid is closed a short time prior to the water solenoid (for example, 160 milliseconds in a preferred embodiment). This allows water to flow and substantially clean the interior of the nozzle of any residual syrup concentrate, thereby minimizing carryover of flavor and color into the next dispensation.

In addition, to reduce solenoid power draw and undesirable heating of the syrup, when the electronics module causes a solenoid to be powered, it initially causes a relatively large amount of current to be sent to the solenoid coil to overcome inertia and pull the solenoid plunger up from its resting position. Once the plunger is raised above the orifice, the electronics module then causes a relatively smaller amount of pulsed current to be sent to the solenoid coil to keep the plunger raised.

A common PCB (printed-circuit board) is used for all the electronics module configurations, but the electronics module functionality varies for each valve model as further explained below. Since the electronics module is generally interchangeable between all preferred valve models (changing to or from the portion-control model also requires a change in the front cover), conversion between one valve model and another may be achieved.

The sanitary lever electronics module 7 is configured to cause the valve to dispense the selected beverage flavor when the lever switch 18 is closed, and to cause the valve to stop dispensing when the lever switch 18 is opened.

The self-serve electronics module 8 is configured to cause the valve to dispense the selected beverage flavor when one of the flavor switches 82 is pressed, and to cause the valve to stop dispensing when that flavor switch is released.

The portion control electronics module 6 is configured to cause the valve to dispense a small (S), medium (M), large (L), and extra-large (XL) portion (see FIG. 1513) of the selected beverage flavor. A switch membrane 74 is included on the front of the electronics module 6 with four portion control size switches 70 and a top-off/cancel switch 72. The dispense time for each size can be adjusted or reprogrammed, or reset to the factory default settings by the operator. The electronic module 6 will keep the appropriate solenoids activated for the entire dispensation cycle, that is, until the preprogrammed dispense time has been reached. If the top-off/cancel switch 72 is pressed during a dispensation cycle, the dispensation is canceled. If the top-off/cancel switch 72 is pressed when the valve is not dispensing, the electronic module causes the appropriate solenoids to be activated for as long as the switch remains pressed, which allows the operator to manually fill or top-off the cup.

In the autofill electronics module 5, the module 5 is configured to cause dispensation to begin when the lever switch 18 is closed. An integrated liquid level sensing circuit sends a fill signal to the electronic module when an insulated cup is substantially filled and the beverage begins to spill from the cup onto the lever 15. The electronic module in turn causes dispensation to stop by deactivating the solenoids as discussed above. A nozzle probe 19 is located in the nozzle 13 above the diffuser and supplies a current to the beverage, and the metal lever 15 functions as a receiving probe. Alternatively, the current may be supplied to the lever, and the nozzle probe functions as the receiving probe. In either case, prior to the cup filling, there is an open circuit caused by the insulated cup, between the nozzle probe and the lever. When the beverage (or beverage foam) begins to spill onto the lever 15, the current flows through the beverage (which is known in the art to conduct current) completing the circuit between the nozzle probe and lever. There is a voltage caused by the passing of current through the resistance of the beverage. This voltage is measured, converted to a digital value, and input to the microprocessor. The microprocessor compares the measured voltage to a preset voltage threshold. If the measured voltage exceeds the threshold, the microprocessor causes the solenoids to deactivate, stopping beverage dispensation. Dispensation may also be stopped if the cup is removed from the lever 15, opening lever switch 18.

The invention has been described in connection with certain exemplary embodiments. However, it should be clear to those skilled in the art that various modifications, additions, subtractions, and changes in form and details may be made to those embodiments without departing from the spirit or scope of the invention as set forth in the claims below.

The invention claimed is:

1. A method for dispensing a beverage, comprising the steps of:

opening a water flow path solenoid;

causing, by the open water flow path solenoid, a water flow path to open;

dispensing water from the water flow path for a first period of time, the amount of water dispensed from the water flow path based in-part on a first cylinder orifice flow area, wherein an increase of fluid pressure of the water reduces the first cylinder orifice flow area;

opening a syrup flow path solenoid corresponding to a beverage flavor;

causing, by the open syrup flow path solenoid, a syrup flow path to open;

dispensing the beverage flavor from the syrup flow path for a second period of time, the amount of beverage flavor dispensed from the syrup flow path based in-part on a second cylinder orifice flow area;

closing the syrup flow path solenoid after the second period of time ends;

causing, by the closed syrup flow path solenoid, the syrup flow path to close; and closing the water flow path solenoid after the first period of time ends, wherein the water flow path solenoid and the syrup flow path solenoid are powered initially by a first amount of current to raise a plunger from a resting position and are powered subsequently by a second amount of current smaller than the first amount of current to keep the plunger in a raised position.

2. The method recited in claim 1, wherein the first period of time is longer than the second period of time.

3. The method recited in claim 1, wherein the step of dispensing the water from the water flow path occurs prior to the step of dispensing the beverage flavor from the syrup flow path.

4. The method recited in claim 1, wherein the step of closing the syrup flow path solenoid occurs before the step of closing the water flow path solenoid.

5. The method recited in claim 1, further comprising: isolating the water flow path and the syrup flow path.

6. The method recited in claim 1, further comprising the step of housing the water flow path solenoid, the water flow path, the syrup flow path solenoid, and the syrup flow path within a valve body having a nozzle.

7. The method recited in claim 6, further comprising the step of flushing the nozzle with the water after the syrup flow path has been closed.

8. The method recited in claim 1, wherein the step of closing the water flow path solenoid occurs approximately 160 milliseconds after the step of closing the syrup flow path solenoid.

9. The method recited in claim 1, wherein the step of opening the syrup flow path solenoid occurs approximately 160 milliseconds after the step of opening the water flow path solenoid.

10. The method recited in claim 1, wherein the steps of opening the water flow path solenoid, opening the syrup flow path solenoid, closing the syrup flow path solenoid, and closing the water flow path solenoid are controlled by an electronics module that is electronically connected to the water flow path solenoid and the syrup flow path solenoid.

11. A method for dispensing a selected beverage flavor from a multi-flavor valve, the multi-flavor valve having a water flow path solenoid and at least three syrup flow path solenoids, the method comprising the steps of:

opening the water flow path solenoid to dispense water along a water flow path, the amount of the water dispensed from the water flow path based in-part on a first cylinder orifice flow area, wherein an increase of fluid pressure of the water reduces the first cylinder orifice flow area;

opening one of the at least three syrup flow path solenoids corresponding to the selected beverage flavor for a predetermined time period to dispense the selected beverage flavor along a syrup flow path, the amount of the selected beverage flavor dispensed from the syrup flow path based in-part on a second cylinder orifice flow area;

closing the one of the at least three syrup flow path solenoids after the selected beverage flavor has been dispensed; and closing the water flow path solenoid after another predetermined period after the one of the at least three syrup flow path solenoids has been closed, wherein the water flow path solenoid and the at least three syrup flow path solenoids are powered initially by a first amount of current to raise a plunger from a resting position and are powered subsequently by a second amount of current smaller than the first amount of current to keep the plunger in a raised position.

12. The method recited in claim 11, wherein the step of opening the water flow path solenoid occurs prior to the step of opening one of the at least three syrup flow path solenoids.

13. The method recited in claim 11, wherein the step of closing the one of the at least three syrup flow path solenoids occurs before the step of closing the water flow path solenoid.

14. The method recited in claim 11, further comprising: isolating the water flow path and the syrup flow path.

15. The method recited in claim 11, further comprising the step of housing the water flow path solenoid, the water flow path, the at least three syrup flow path solenoids, and the syrup flow path within a valve body having a nozzle.

16. The method recited in claim 15, further comprising the step of flushing the nozzle with the water after the one of the at least three syrup flow path solenoids has been closed.

17. The method recited in claim 11, wherein the step of closing the water flow path solenoid occurs approximately 160 milliseconds after the step of closing the one of the at least three syrup flow path solenoids.

18. The method recited in claim 11, wherein the second amount of current comprises a pulsed current.

* * * * *